US006008170A

United States Patent [19]

Tanaka et al.

[11] Patent Number: 6,008,170

[45] Date of Patent: Dec. 28, 1999

[54] CONTACT LENS CLEANING SOLUTION AND METHOD FOR CLEANING CONTACT LENSES USING THE SAME

[75] Inventors: Shinji Tanaka, Ichinomiya; Kenji Narushima, Tsushima; Junji Niwa, Jimokuji-cho; Emi Tanimoto, Gifu, all of Japan

[73] Assignee: Tomey Technology Corporation, Japan

[21] Appl. No.: 08/952,740

[22] PCT Filed: Mar. 26, 1997

[86] PCT No.: PCT/JP97/01003

§ 371 Date: Nov. 25, 1997

§ 102(e) Date: Nov. 25, 1997

[87] PCT Pub. No.: WO97/37269

PCT Pub. Date: Oct. 9, 1997

[30] Foreign Application Priority Data

Mar. 29, 1996 [JP] Japan ..... 8-076347

[51] Int. Cl.[6] ..... C11D 3/386; C11D 3/48

[52] U.S. Cl. ..... 510/114; 510/112; 510/392; 510/393; 134/42; 435/264; 514/839

[58] Field of Search ..... 510/114, 112, 510/392, 490, 393, 492, 108, 113, 489, 499; 134/42; 435/264; 514/839; 422/28

[56] References Cited

U.S. PATENT DOCUMENTS

| | | | |
|---|---|---|---|
| 3,910,296 | 10/1975 | Karageozian et al. | 134/2 |
| 4,096,870 | 6/1978 | Manfuso, Jr. | 134/28 |
| 4,285,738 | 8/1981 | Ogata | 134/26 |
| 4,500,441 | 2/1985 | Tanaka et al. | 252/89.1 |
| 4,710,313 | 12/1987 | Miyajima et al. | 252/105 |
| 4,738,790 | 4/1988 | Miyajima et al. | 252/105 |
| 4,921,630 | 5/1990 | Bhatia | 252/174 |
| 5,314,823 | 5/1994 | Nakagawa | 435/264 |
| 5,460,658 | 10/1995 | Nakagawa et al. | 134/42 |

FOREIGN PATENT DOCUMENTS

| | | |
|---|---|---|
| 0 462 460 A2 | 12/1991 | European Pat. Off. . |
| 48-7910 | 1/1973 | Japan . |
| 48-37910 | 11/1973 | Japan . |
| 63-246718 | 10/1988 | Japan . |
| 2-168224 | 6/1990 | Japan . |
| 3-235914 | 10/1991 | Japan . |
| 6-95043 | 4/1994 | Japan . |

*Primary Examiner*—Yogendra Gupta
*Assistant Examiner*—Gregory E. Webb
*Attorney, Agent, or Firm*—Parkhurst & Wendell, L.L.P.

[57] ABSTRACT

The present invention provides a contact lens cleaning solution which is capable of, simultaneously and in a simplified manner, rendering surfaces of the contact lens hydrophilic and cleaning the contact lens for removal of protein deposits, without suffering from reduction of the cleaning effect of a protease, and also provides a method of cleaning a contact lens which is capable of rendering the surfaces of the contact lens hydrophilic while, at the same time, cleaning the contact lens for removal of the protein deposits, by using the contact lens cleaning solution as described above.

A desired contact lens cleaning solution is prepared, which contains a protease in an amount effective for removing protein adhering or clinging to the contact lens and gum arabic as a hydrophilicity rendering component, wherein divalent metal ions in the gum arabic are removed or inactivated. The contact lens is immersed in such a contact lens cleaning solution, so as to remove the protein adhering or clinging to the contact lens and render the surfaces of the contact lens hydrophilic.

25 Claims, No Drawings

CONTACT LENS CLEANING SOLUTION AND METHOD FOR CLEANING CONTACT LENSES USING THE SAME

BACKGROUND OF THE INVENTION

1. Field of the Art

The present invention relates to a contact lens cleaning solution and a method of cleaning a contact lens using the solution.

2. Discussion of the Related Art

As conventionally used non-water-absorbable contact lenses, there are known a hard contact lens of polymer made mainly of methyl methacrylate, a high-degree oxygen permeable hard contact lens of polymer made mainly of siloxanyl methacrylate, fluoroalkyl methacrylate, or the like, and a non-water-absorbable soft contact lens made mainly of a silicone rubber that contains polydimethylsiloxane as a major component, or a butyl rubber that contains butyl acrylate as a major component. The surfaces of these non-water-absorbable contact lenses are hydrophobic. In particular, the surfaces of the high-degree oxygen permeable contact lens which has recently attracted public attention exhibit a high degree of hydrophobic property. The hydrophobic property of the lens surfaces causes a problem that lipid deposits which derive from tear fluid and lipid of the eyes adhere to the lens surfaces when the non-water-absorbable contact lenses are worn on the eyes of a user, whereby the contact lens is clouded, leading to deteriorated eyesight of the lens user.

In an attempt to deal with the above-described problem, there are proposed various methods of rendering the hydrophobic surfaces of the contact lens hydrophilic. Examples of the proposed methods include a plasma surface treatment and a chemical treatment using an acid or an alkali. However, the contact lens treated by these methods does not exhibit satisfactory durability in its hydrophilic property at the surfaces thereof, and it is considerably cumbersome to repeat the treatment for rendering the lens surfaces hydrophilic. Thus, the proposed methods are not practical.

Further, there is known a method which uses a so-called wetting solution so as to improve the surfaces of the contact lens. In this method, the contact lens is immersed in a solution that contains a hydrophilic polymer, so that the polymer is fixed to the surfaces of the contact lens. This method permits the contact lens to be repeatedly subjected to the treatment for rendering the lens surfaces hydrophilic, by simply immersing the contact lens in the solution as needed. Thus, the hydrophilic property of the contact lens surfaces is comparatively easily maintained. For instance, JP-B-48-37910 discloses a solution for a contact lens containing polyvinyl alcohol and a water-soluble polymer such as hydroxyethyl cellulose and polyvinyl pyrrolidone.

Such a treatment solution is effective for a contact lens having a comparatively low degree of hydrophobic property, such as a high-degree oxygen permeable contact lens of polymer made mainly of methyl methacrylate. However, the solution is not effective for a contact lens having a high degree of hydrophobic property, such as a non-water-absorbable contact lens which contains a large amount of a silicone or fluorine component, since the water-soluble polymer included in the solution is not likely to adhere to the surfaces of the contact lens. Thus, the solution as described above is not capable of effectively rendering the surfaces of the contact lens hydrophilic.

JP-A-63-246718 discloses a surface treatment solution for a contact lens which consists of a polymeric material with an ionic charge. In effecting the treatment for rendering the surfaces of the contact lens hydrophilic by using the disclosed surface treatment solution, the surfaces of the contact lens need to have an ionic charge opposite to that of the solution. Further, the density of the opposite ionic charge of the lens surfaces needs to be higher than a certain level. For satisfying these requirements, it is necessary to effect a treatment for increasing the density of the ionic charge of the contact lens surfaces, prior to the treatment for rendering the lens surfaces hydrophilic, undesirably making the procedure cumbersome. Like the wetting solution as described above, the disclosed polymeric solution which contains the ionic group that gives the ionic charge as described above is not capable of giving a satisfactory degree of hydrophilic property to the non-water-absorbable contact lens which contains a large amount of the silicone or fluorine component.

JP-A-3-235914 discloses various contact lens solutions which contain gum arabic as a hydrophilicity rendering component. The gum arabic contained in the contact lens solutions is effectively adsorbed on the highly hydrophobic surfaces of the contact lens. Accordingly, the solutions disclosed in the publication are effective to give the hydrophilic property to the non-water-absorbable contact lens which contains a large amount of silicone or fluorine component. The contact lens whose surfaces are rendered hydrophilic by using these solutions assures the lens user of its comfortable wearing.

While the contact lenses are worn on the eyes, protein included in the tear fluid adheres or clings to the surfaces of the contact lenses. In view of this, there have been conventionally proposed various methods of cleaning and removing protein deposits adhering to the contact lenses by using a cleaning agent that contains a protease, for instance. JP-A-2-168224 and JP-A-6-9504 disclose methods of removing such protein deposits by decomposition using the protease.

The treatment for rendering the lens surfaces hydrophilic by the gum arabic and the treatment for removing the protein deposits by the protease are both necessary for the contact lenses to be worn on the eyes of the user. It would be considerably convenient to the user if the user can effect these treatments simultaneously in one step, rather than in different steps. In other words, the surfaces of the contact lens can be rendered hydrophilic while, at the same time, the protein adhering to the surfaces of the contact lens can be removed, in a single step of immersing the contact lens in a mixture of a solution containing the protease and a solution of the gum arabic which effectively gives the hydrophilic property to the contact lens.

However, a study by the inventors of the present invention revealed that such a contact lens solution containing the gum arabic and protease considerably deteriorates a cleaning effect to be exhibited by the protease, namely, an effect of the protease to remove the protein deposits by decomposition.

SUMMARY OF THE INVENTION

The present invention was developed in view of the above-described situations. It is therefore an object of the invention to provide a contact lens cleaning solution which is capable of, simultaneously and in a simplified manner, rendering surfaces of the contact lens hydrophilic and removing protein deposits from the contact lens, without suffering from reduction of the cleaning effect of a protease. It is another object of the invention to provide a method of cleaning a contact lens which is capable of rendering the surfaces of the contact lens hydrophilic while, at the same time, removing the protein deposits from the contact lens.

In an effort to attain the above objects, the inventors of the present invention have paid attention to substances included in the gum arabic and made an extensive study on the substances which lower the cleaning effect of the protease. The study revealed that the function of the protease was deteriorated by divalent metal ions, such as calcium and magnesium ions, which divalent metal ions are included in the gum arabic that serves as the hydrophilicity rendering component. The inventors of the present invention have found that an inhibitory action of the divalent metal ions on the function of the protease is effectively prevented or reduced by removing the divalent metal ions from the gum arabic, or by inactivating the divalent metal ions by chelation.

The present invention was completed in the light of the above finding, and provides a contact lens cleaning solution characterized by containing a protease in an amount effective for removing protein adhering or clinging to said contact lens, and gum arabic as a hydrophilicity rendering component, wherein divalent metal ions in said gum arabic are removed or inactivated.

When the contact lens is treated with the present contact lens cleaning solution which contains the gum arabic as the hydrophilicity rendering component, the gum arabic is advantageously adsorbed on the hydrophobic surfaces of the contact lens, so that the originally hydrophobic surfaces of the contact lens are effectively rendered hydrophilic. In addition, the divalent metal ions which derive from the gum arabic are removed or inactivated in the present cleaning solution, to thereby effectively prevent reduction of the cleaning effect of the protease included in the cleaning solution. Therefore, the contact lens cleaning solution according to the present invention has an enhanced hydrophilicity rendering capability and an enhanced cleaning effect with respect to the protein deposits.

In one preferred form of the contact lens cleaning solution of the present invention, the divalent metal ions in the gum arabic are removed by dialysis or gel filtration, or by precipitation reaction with a precipitant. Owing to the dialysis or gel filtration, the low-molecular divalent metal ions are effectively separated from the high-molecular gum arabic. If the cleaning solution contains a suitable precipitant, the divalent metal ions in the cleaning solution are deposited or precipitated by reaction with the precipitant, whereby the divalent metal ions are easily removed from the solution containing the gum arabic.

In another preferred form of the contact lens cleaning solution of the present invention, a chelating agent is further contained in an amount sufficient for chelation of the divalent metal ions which are present in the gum arabic. The divalent metal ions are inactivated by the chelation using the chelating agent. The divalent metal ions which have been inactivated by the chelating agent are not present in a free state in the contact lens cleaning solution. Accordingly, the present contact lens cleaning solution is free from the inhibitory action of the divalent metal ions on the cleaning effect to be exhibited by the protease.

The contact lens cleaning solution according to the present invention preferably contains the gum arabic generally in an amount of 0.1–10 wt. %.

In a further preferred form of the contact lens cleaning solution of the present invention, the cleaning solution further contains as an additional component a thickener such that an aqueous solution which contains only said thickener at the same concentration as a concentration of said thickener in said cleaning solution gives surface tension of not lower than 50 dyn/cm at ordinary temperature. The thickener is advantageously selected from the group consisting of: polyvinyl pyrrolidone, copolymer of methoxyethylene and maleic anhydride, xanthan gum, and hydroxyethyl cellulose. The thickener serves as the additional component that gives the surface tension higher than the minimum surface tension of the gum arabic, i.e., 50 dyn/cm. The thickener adjusts the viscosity of the cleaning solution to a suitable level without adversely influencing the hydrophilicity rendering action of the gum arabic. Accordingly, the touch of the cleaning solution as felt by the user during the cleaning operation of the contact lens is effectively improved, so that the present cleaning solution exhibits an enhanced cleaning effect with respect to lipid deposits.

In still another preferred form of the contact lens cleaning solution of the present invention, at least one of a preservative, a buffer and a tonicity agent is further contained therein.

The present invention also provides a method of cleaning a contact lens by using the above-described contact lens cleaning solution, the method being characterized in that the contact lens is immersed in the contact lens cleaning solution to remove protein adhering or clinging to the contact lens and to render surfaces of the contact lens hydrophilic. According to this method, the surfaces of the contact lens can be rendered hydrophilic while the protein deposits can be removed, simultaneously in a single step of immersion of the contact lens in the cleaning solution.

The present invention further provides a method of cleaning a contact lens characterized by using a gum arabic solution which contains gum arabic as a hydrophilicity rendering component and from which divalent metal ions have been removed or in which the divalent metal ions have been inactivated, the contact lens being immersed in a diluted mixture which is obtained by diluting a protease solution with said gum arabic solution, so as to remove protein adhering or clinging to the contact lens and to render surfaces of the contact lens hydrophilic.

If the gum arabic solution and the protease solution which are prepared independently of each other are mixed when the contact lens is cleaned, it is possible to adjust the concentration of the protease included in the obtained contact lens cleaning solution to a desired value. Accordingly, the cleaning solution can be prepared so as to deal with various protein deposits of the contact lens, permitting the protease to exhibit a high cleaning effect.

DETAILED DESCRIPTION OF THE PREFERRED EMBODIMENT

The contact lens cleaning solution according to the present invention utilizes the gum arabic as the hydrophilicity rendering component, which gum arabic is described in the Japanese Pharmacopoeia, 1st edition. The gum arabic is a secretion from a stem or branch of Acacia senegal or other plant of the same genus as the Acacia senegal, and is known as a natural polymer having a high degree of safety. The gum arabic includes, as a major component, arabic acid which is present in the form of a salt of divalent metal ions such as calcium and magnesium ions.

The gum arabic as described above is utilized as the hydrophilicity rendering component in the present invention. The study by the inventors of the present invention revealed that the cleaning effect to be exhibited by the protease is lowered due to the divalent metal ions such as calcium and magnesium ions included in the gum arabic, if the gum arabic is used in combination with the protease so as to provide a contact lens cleaning solution capable of decomposing and removing the protein deposits while, at the same time, giving the contact lens the hydrophilic property. Accordingly, the present invention uses the gum arabic wherein the divalent metal ions are removed or inactivated.

The divalent metal ions may be removed from the gum arabic by dialysis or gel filtration, or by adding a precipitant which precipitates the divalent metal ions. For inactivating the divalent metal ions in the gum arabic, a chelating agent is added in an amount sufficient for chelation of the divalent metal ions. It is needless to say that the divalent metal ions in the gum arabic may be removed or inactivated by any other known methods.

Described more specifically, when the divalent metal ions are removed by the dialysis, a suitable solution such as an aqueous solution of the gum arabic is placed as an internal liquid on one side of a semipermeable membrane while an external liquid such as deionized water is placed on the other side of the membrane. Since the molecules of the gum arabic in the solution have a high molecular weight, they remain on the side of the internal liquid without passing through the semipermeable membrane. On the other hand, divalent metal ions such as calcium and magnesium ions which are ionized from the molecules of the gum arabic have a low molecular weight, and they move toward the external liquid through the semipermeable membrane. By replacing the external liquid with a new one from time to time or continuously, the low-molecular divalent metal ions are substantially completely removed from the gum arabic solution. For completely removing the divalent metal ions from the gum arabic, the dialysis is preferably effected until the divalent metal ions are not detected in the external liquid and until the divalent metal ions are not detected finally in the internal liquid. In practical operation, however, it is difficult to completely remove the divalent metal ions in the gum arabic solution by the dialysis. Namely, the divalent metal ions may be included in an amount lower than a detection limit in the internal and external liquids even when the divalent metal ions are no longer detected therein. In view of this, it is more preferable to add a precipitant or a chelating agent as described below, in a sufficient amount for precipitation or chelation of the divalent metal ions whose concentration is lower than the detection limit.

The divalent metal ions may be removed by any known gel filtration methods which utilize gels such as a dextran gel, an agar gel, and an acrylamide gel, for instance. According to a suitably selected gel filtration method, the low-molecular divalent metal ions such as calcium and magnesium ions are separated from the high-molecular gum arabic.

For removing the divalent metal ions from the gum arabic by using the precipitant, there is added to the gum arabic solution a sufficient amount of the precipitant which precipitates the divalent metal ions included in the gum arabic, so that the precipitate which derives from the divalent metal ions and which was generated by the reaction with the precipitant is removed from the gum arabic solution according to a known method such as centrifugal separation or filtration. As the precipitant, oxalate or carbonate is preferably used, for instance.

The divalent metal ions included in the gum arabic are inactivated by chelation using the chelating agent. The addition of a sufficient amount of the chelating agent that allows the chelation of the divalent metal ions prevents reduction of the cleaning effect of the protease, which reduction would be caused by the divalent metal ions. It is preferable to employ an ophthalmologically permissible chelating agent such as ethylene diamine tetraacetic acid (EDTA), citric acid, nitrilotriacetic acid, uramildiacetic acid, phosphoric acid or water-soluble salts thereof.

In the present invention, a suitable protease or proteolytic enzyme is added to the gum arabic solution from which the divalent metal ions have been substantially removed or wherein the divalent metal ions have been inactivated as described above, so as to provide the desired contact lens cleaning solution. In the thus prepared contact lens cleaning solution, the divalent metal ions in the gum arabic have been removed or inactivated, so that the cleaning effect of the protease is not inhibited by the divalent metal ions. Accordingly, the present contact lens cleaning solution has a significantly high cleaning capability so as to remove the protein adhering or clinging to the contact lens surfaces.

As the protease included in the present contact lens cleaning solution, it is possible to employ any known protease which have been conventionally used for removal of the protein deposits on the contact lens. In particular, the protease which derive from microorganisms are preferably employed. Commercially available protease are suitably used, such as "Bioprase" (available from Nagase Seikagaku Kogyo K.K., Japan), "Esperase" (available from Novo Nordisk Bioindustry Ltd., Japan), "Clear Lens Pro" (available from Novo Nordisk Bioindustry Ltd., Japan), "Alkali protease" (available from Kyowa Sorzyme Co., Ltd., Japan) and "Protease N" (available from Amano Pharmaceutical Co., Ltd., Japan). The amount of the protease to be used is suitably determined depending upon the desired cleaning effect, but is preferably adjusted to within a range of 0.01–5 wt. %.

The amount of the gum arabic included in the present contact lens cleaning solution is suitably determined depending on the intent of rendering the hydrophilicity, but is generally in a range of 0.1–10 wt. %, preferably in a range of 0.3–5 wt. %. If the amount of the gum arabic is smaller than 0.1 wt. %, the surfaces of the contact lens are not rendered hydrophilic to a sufficient extent. On the other hand, if the amount of the gum arabic exceeds 10 wt. %, fluidity of the contact lens cleaning solution tends to be lowered and impurities which derive from the gum arabic increase, making the handling of the cleaning solution difficult.

To the present contact lens cleaning solution, there is further added a suitable thickener so as to give a suitable degree of viscosity to the cleaning solution, improve the touch of the cleaning solution and enhance a cleaning effect with respect to the lipid deposits. As the thickener to be added to the present cleaning solution, polyvinyl pyrrolidone, copolymer of methoxyethylene and maleic anhydride, xanthan gum or hydroxyethyl cellulose is preferably used. The cleaning solution contains as an additional component a thickener such that an aqueous solution which contains only the thickener at the same concentration as a concentration of the thickener in the cleaning solution gives surface tension of not lower than 50 dyn/cm at ordinary temperature. Accordingly, the addition of the thickener is effective to adjust the viscosity of the cleaning solution to a suitable value without adversely influencing the action of the gum arabic to render the contact lens surface hydrophilic.

A thickener may be added alone, or a plurality of thickeners may be added in combination. In any case, the amount of the thickener(s) is preferably in a range of 0.01–10 w/v %, more preferably in a range of 0.1–5 w/v %. If the amount of the thickener(s) is smaller than 0.01 w/v %, the viscosity of the cleaning solution is not sufficiently increased. On the other hand, if the amount of the thickener(s) is larger than 10 w/v %, the fluidity of the contact lens cleaning solution tends to be lowered, undesirably making the handling thereof difficult.

The present contact lens cleaning solution may further contain various other additional components as needed such as a preservative, a buffer and a tonicity agent.

Described more specifically, the preservative is effective to prevent the contact lens cleaning solution from being contaminated with bacteria. Examples of the preservative include: a phenyl mercury preservative such as nitric acid phenyl mercury or acetic acid phenyl mercury; a quaternary ammonium salt preservative such as benzalkonium chloride, pyridinium bromide, chlorohexidine or polyhexamethylene biguanide; an alcoholic preservative such as chlorobutanol; thimerosal; and methyl paraben. Although the amount of the preservative to be used differs depending upon the kind thereof, the preservative is included in the contact lens cleaning solution generally in an amount of 0.0001–0.5 wt. %.

The buffer is effective to keep the pH of the obtained contact lens cleaning solution at a level close to that of the tear fluid, prevent a change in the pH due to external factors, and maintain the configuration of the contact lens while it is cleaned. Examples of the buffer include combinations of: boric acid and sodium borate; acetic acid and sodium acetate; phosphoric acid and sodium phosphate; citric acid and sodium citrate; lactic acid and sodium lactate; and amino acid such as glycine or glutamic acid and sodium salt thereof. These examples of the buffer are ophthalmologically permissible. The buffer is included in the contact lens cleaning solution preferably in an amount of 0.01–0.5 mol/L, more preferably in an amount of 0.05–0.15 mol/L. If the amount of the buffer is smaller than 0.01 mol/L, the buffering effect is insufficient. On the other hand, the amount of the buffer exceeding 0.5 mol/L does not significantly improve the buffering effect, but may even cause an increase of the osmotic pressure of the cleaning solution, thereby adversely influencing the configuration of the contact lens.

The tonicity agent is effective to adjust the osmotic pressure of the contact lens cleaning solution to a level close to that of the tear fluid, i.e., 280–300 mOsm/kg, so as to reduce irritation to the eyes. Examples of the tonicity agent include an ophthalmologically permissible inorganic salt such as sodium chloride or potassium chloride, and the above-described buffers. The tonicity agent is included in the contact lens cleaning solution preferably in an amount of 0.01–0.5 mol/L, more preferably in an amount of 0.05–0.15 mol/L. If the amount of the tonicity agent is smaller than 0.01 mol/L, the osmotic pressure of the contact lens cleaning solution is undesirably lowered. On the contrary, the amount of the tonicity agent exceeding 0.5 mol/L undesirably increases the osmotic pressure of the contact lens cleaning solution, to thereby cause eye irritation.

For rendering the surfaces of the contact lens hydrophilic and cleaning the contact lens for removal of the protein deposits, the contact lens is simply immersed in the present contact lens cleaning solution prepared as described above, and subsequently rinsed. The surfaces of the contact lens are rendered hydrophilic owing to the gum arabic by simply immersing the contact lens in the present cleaning solution. In the present contact lens cleaning solution, the divalent metal ions included in the gum arabic are removed or inactivated as described above, and the cleaning effect of the protease is not deteriorated, so that the protein adhering to the surfaces of the contact lens is effectively decomposed and removed therefrom. Accordingly, the present contact lens cleaning solution is capable of giving the contact lens the hydrophilic property while, at the same time, removing the protein from the lens surfaces.

The contact lens may be otherwise treated according to a method other than the above-described method using the contact lens cleaning solution wherein the protease is included in the gum arabic solution. Namely, there are separately prepared a gum arabic solution in which the divalent metal ions in the gum arabic have been removed or inactivated, and a protease solution. Upon cleaning the contact lens, the gum arabic solution and the protease solution are mixed with each other, and the contact lens is immersed in the mixed solution.

In the cleaning method as described just above, the gum arabic solution and the protease solution are mixed with each other each time the contact lens is subjected to the cleaning treatment. According to this arrangement, the cleaning solution can be prepared depending upon the amount of the protein deposits adhering to the contact lens to be treated. Therefore, the contact lens can be effectively cleaned at the same time when its surfaces are rendered hydrophilic.

EXAMPLES

To further clarify the concept of the present invention, some examples of the invention will be described. It is to be understood, however, that the present invention is not limited to the details of the illustrated examples, but may be embodied with various changes, modifications and improvements, which may occur to those skilled in the art without departing from the spirit of the present invention.

<Preparation of artificial tear fluid>

Initially, there was prepared an aqueous solution which contains the following components in the respective amounts indicated below, by using purified water. The pH of the obtained aqueous solution was adjusted to 7.0 by 1N sodium hydroxide, to thereby provide an artificial tear fluid.

| | |
|---|---|
| albumin of bovine origin | 0.388 w/v % |
| γ-globulin of bovine origin | 0.161 w/v % |
| egg-white lysozyme | 0.12 w/v % |
| sodium chloride | 0.9 w/v % |
| calcium chloride dihydrate | 0.015 w/v % |
| sodium dihydrogenphosphate dihydrate | 0.104 w/v % |

<Preparation of artificially clouded contact lenses>

There were prepared sample contact lenses each of which is made of a copolymer consisting principally of tris (trimethylsiloxy)silylpropyl methacrylate and 1,1,1,3,3,3-hexafluoro-2-propyl methacrylate. Each contact lens was immersed in 10 mL of the artificial tear fluid prepared as described above. In this state, the contact lens was subjected to a heat treatment at 80° C. for 30 minutes. Subsequently, the contact lens was washed by rubbing with tap water. After this operation was repeated five times, it was confirmed that the surfaces of each of the contact lenses were completely clouded or turbid. These contact lenses were used as test lenses in the examples described below. Cloudiness or turbidity of each of the test lenses was measured by image analysis as explained below. The turbidity of each test contact lens was 255.

<Image analysis method>

Monochrome image data of the test contact lens obtained by a CCD camera "XC-77" (available from SONY CORPORATION, Japan) was input to an image analyzer "V2" (available from Toyo Boseki Co., Ltd., Japan). The input monochrome image data was subjected to an analog/digital conversion by the image analyzer, and the obtained digital image data was decomposed into sets of picture element data corresponding to 512 picture elements (columns×rows). Each set of picture element data was converted into digital image data representing one of 256 gradations (brightness values). The gradations of all the picture element data sets were processed so as to provide a histogram.

Example 1

10 mL of 2.0% gum arabic solution as a dialysis internal liquid was subjected to dialysis by using a dialysis membrane available from SPECTRUM MEDICAL INDUSTRIES, INC., U.S.A., while deionized water was used as a dialysis external liquid. During the dialysis operation, the dialysis external liquid was replaced with new one. The dialysis operation was effected until the divalent metal ions were not detected in the dialysis external liquid. After the dialysis operation, the gum arabic solution as the dialysis internal liquid was diluted with purified water so as to have a concentration of 1.0%. The pH of the diluted gum arabic solution was adjusted to 7.0 by using 1N aqueous solution of sodium hydroxide. A cleaning solution was prepared by mixing 2.0 mL of the gum arabic solution from which the divalent metal ions have been removed by the above-described dialysis operation, and 50 $\mu$L of protease solution which was obtained by diluting commercially available "Esperase" (in liquid form and available from Novo Nordisk Bioindustry Ltd., Japan) with purified water so as to have a concentration of 5%. In the thus obtained cleaning solution, the test contact lens was immersed and kept at room temperature for one hour. Thereafter, the test contact lens was taken out of the cleaning solution, washed by rubbing with tap water, and dried. Then, the cloudiness or turbidity of the contact lens was obtained by the above-described image analysis. The turbidity was 21. Thus, it was confirmed that the cleaning solution in this example exhibited a considerably high cleaning effect.

Example 2

10 mL of 2.0% gum arabic solution was reacted with 10 mL of 0.045% aqueous solution of oxalic acid as a precipitant. The mixture was subjected to centrifugal separation at 3000 rpm for five minutes, so as to remove the precipitate therefrom. Then, the obtained supernatant liquid was adjusted of its pH to 7.0 by the 1N aqueous solution of sodium hydroxide. As in the above Example 1, a cleaning solution was obtained by mixing 2.0 mL of gum arabic solution from which the divalent metal ions have been removed by the addition of the precipitant, and 50 $\mu$L of the protease solution. The test contact lens was soaked in the thus prepared cleaning solution and kept at room temperature for one hour. Thereafter, the contact lens was taken out of the cleaning solution, washed by rubbing with tap water, and dried. The cloudiness or turbidity of the contact lens was obtained by the image analysis. The turbidity was 13. Thus, it was confirmed that the cleaning solution in this example exhibited an effective cleaning effect.

Examples 3–5 and Comparative Examples 1–6

Cleaning solutions according to Examples 3–5 and cleaning solutions as Comparative Examples 1–6 were respectively prepared by mixing 2.0 mL of gum arabic solutions having different compositions as indicated in the following TABLE 1, and 50 $\mu$L of the protease solution, as in the above Example 1. The test contact lenses were immersed in the thus prepared cleaning solutions, respectively, and kept at room temperature for one hour. Thereafter, the test contact lenses were taken out of the respective cleaning solutions, washed by rubbing with tap water, and dried. The cloudiness or turbidity of each of the test contact lenses was obtained by the image analysis. The results are also shown in the TABLE 1. Similarly, the cloudiness or turbidity was obtained for a contact lens which was not treated with the protease. The result of this non-treated contact lens is also indicated in the TABLE 1.

TABLE 1

| | | | chelating agent | | |
|---|---|---|---|---|---|
| | | gum arabic | EDTA | citric acid | turbidity |
| Present Invention | 3 | 0.3 | 0.03 | — | 15 |
| | 4 | 1.0 | 0.1 | — | 5 |
| | 5 | 1.0 | — | 0.07 | 6 |
| Comparative Examples | 1 | 0.3 | — | — | 127 |
| | 2 | 0.3 | 0.015 | — | 220 |
| | 3 | 0.3 | 0.0225 | — | 54 |
| | 4 | 1.0 | — | — | 229 |
| | 5 | 1.0 | 0.05 | — | 107 |
| | 6 | 1.0 | 0.075 | — | 43 |
| * | | — | — | — | 255 |

*: Test contact lens which was not treated with the protease.

The cleaning solutions according to the Examples 3–5 contained EDTA or citric acid as the chelating agent in a sufficient amount for chelation of the divalent metal ions which were included in the gum arabic, so that they exhibited an excellent cleaning effect without suffering from reduction of the cleaning capability of the protease. The cleaning effect did not substantially change even when the amount of the EDTA was increased ten times the amounts of the EDTA in the cleaning solutions of the Examples 3 and 4, namely, 0.3% and 1.0%. In other words, the excessive amount of the EDTA does not significantly increase the cleaning effect of the cleaning solution. Thus, it was confirmed that the EDTA is effective to inactivate the divalent metal ions included in the gum arabic, so that the cleaning effect of the protease is not lowered. In contrast, the cleaning capability of the protease was lowered and the turbidity of the contact lens was relatively high in the Comparative Examples 1–6 since the chelating agent was not included or the amount of the chelating agent was insufficient in the cleaning solutions of these comparative examples.

Examples 6–9 and Comparative Examples 7–14

Similar experiments as in the above Examples were effected by using other protease. Described in detail, there were prepared contact lens cleaning solutions according to Examples 6–9 and according to Comparative Examples 7–14 so as to have the respective compositions as indicated in the following TABLE 2, by using water as a medium. The test contact lenses were soaked in 2.0 mL of the thus obtained cleaning solutions, respectively, and kept at room temperature for one hour. Thereafter, each of the contact lenses was taken out of the cleaning solution, washed by rubbing with tap water, and dried. The cloudiness or turbidity was obtained for each contact lens by the image analysis. The results are also indicated in the TABLE 2.

TABLE 2

| | gum arabic | *1 EDTA | *2 A | B | C | D | turbidity |
|---|---|---|---|---|---|---|---|
| Present Invention | | | | | | | |
| 6 | 1.0 | 0.1 | 0.12 | — | — | — | 22 |
| 7 | 1.0 | 0.1 | — | 0.12 | — | — | 66 |
| 8 | 1.0 | 0.1 | — | — | 0.12 | — | 72 |
| 9 | 1.0 | 0.1 | — | — | — | 0.12 | 45 |
| Comparative Examples | | | | | | | |
| 7 | 1.0 | — | 0.12 | — | — | — | 210 |
| 8 | 1.0 | — | — | 0.12 | — | — | 255 |
| 9 | 1.0 | — | — | — | 0.12 | — | 251 |
| 10 | 1.0 | — | — | — | — | 0.12 | 252 |
| 11 | 1.0 | 0.05 | 0.12 | — | — | — | 255 |
| 12 | 1.0 | 0.05 | — | 0.12 | — | — | 253 |
| 13 | 1.0 | 0.05 | — | — | 0.12 | — | 243 |
| 14 | 1.0 | 0.05 | — | — | — | 0.12 | 255 |

unit: w/v %
*1: chelating agent
*2: protease
A: "Clear Lens Pro" in powder form (available from Novo Nordisk Bioindustry Ltd., Japan)
B: "Bioprase" in powder form (available from Nagase Seikagaku Kogyo K.K., Japan)
C: "Protease N" in powder form (available from Amano Pharmaceutical Co., Ltd., Japan)
D: "Alkali protease" in liquid form (available from Kyowa Sorzyme Co., Ltd., Japan)

The cleaning solutions according to the Examples 6–9 contained the EDTA as the chelating agent in a sufficient amount for chelation of the divalent metal ions which were included in the gum arabic, so that they exhibited an excellent cleaning effect without suffering from reduction of the cleaning capability of the protease. In contrast, the cleaning capability of the protease was lowered and the turbidity of the contact lens was relatively high in the Comparative Examples 7–14 since the chelating agent was not included or the amount of the chelating agent was insufficient in the cleaning solutions according to these comparative examples.

As is apparent from the above results, the contact lens cleaning solution according to the present invention effectively gives the hydrophilic property to the surfaces of the contact lens originally having a high degree of hydrophobic property, especially to the surfaces of the high-degree oxygen permeable contact lens, based on the adsorption of the gum arabic on the surfaces of the contact lens. Moreover, the divalent metal ions in the gum arabic are removed or inactivated in the present contact lens cleaning solution, so that the cleaning solution is capable of exhibiting a high degree of cleaning effect with respect to the protein deposits without suffering from reduction of the cleaning capability of the protease. According to the present invention, the surfaces of the contact lens are rendered hydrophilic by simply immersing the contact lens in the present contact lens cleaning solution. Therefore, the treatment for rendering the contact lens surfaces hydrophilic can be repeated as needed in a simplified manner, so as to assure excellent durability of the hydrophilic property of the contact lens surfaces.

Industrial Applicability

It will be understood from the above description that the present invention advantageously provides a cleaning solution which is capable of rendering the highly hydrophobic surfaces of the contact lens hydrophilic while, at the same time, decomposing and removing the protein adhering or clinging to the surface of the contact lens. The present invention also provides the method of cleaning the contact lens by using the cleaning solution as described above.

What is claimed is:

1. A contact lens cleaning solution comprising a protease in an amount effective for removing protein adhering or clinging to said contact lens, and gum arabic as a hydrophilicity rendering component, wherein divalent metal ions in said gum arabic are removed.

2. A contact lens cleaning solution according to claim 1, wherein said divalent metal ions in said gum arabic are removed by one of dialysis, gel filtration, and precipitation reaction with a precipitant.

3. A contact lens cleaning solution according to claim 1, wherein said gum arabic is contained in an amount of 0.1–10 wt. %.

4. A contact lens cleaning solution according to claim 1, further containing as an additional component a thickener other than gum arabic such that an aqueous solution which contains only said thickener at the same concentration as a concentration of said thickener in said cleaning solution gives surface tension of not lower than 50 dyn/cm at ordinary temperature.

5. A contact lens cleaning solution according to claim 4, wherein said thickener is selected from the group consisting of: polyvinyl pyrrolidone, copolymer of methoxyethylene and maleic anhydride, xanthan gum, and hydroxyethyl cellulose.

6. A contact lens cleaning solution according to claim 4, wherein said thickener is contained in an amount of 0.01–10 wt. %.

7. A contact lens cleaning solution according to claim 1, further containing at least one of a preservative, a buffer and a tonicity agent.

8. A contact lens cleaning solution according to claim 7, wherein said preservative is contained in an amount of 0.0001–0.5 wt. %.

9. A contact lens cleaning solution according to claim 7, wherein said buffer is contained in an amount of 0.01–0.5 mol/L.

10. A contact lens cleaning solution according to claim 7, wherein said tonicity agent is contained in an amount of 0.01–0.5 mol/L.

11. A method of cleaning a contact lens by using a contact lens cleaning solution as defined in claim 1, said method being characterized in that said contact lens is immersed in said contact lens cleaning solution to remove protein adhering or clinging to said contact lens and to render surfaces of said contact lens hydrophilic.

12. A method of cleaning a contact lens comprising providing using a gum arabic solution which contains gum arabic as a hydrophilicity rendering component and from which divalent metal ions have been removed, said contact lens being immersed in a diluted mixture obtained by diluting a protease solution with said gum arabic solution, so as to remove protein adhering or clinging to said contact lens and to render surfaces of said contact lens hydrophilic.

13. A method according to claim 12, wherein said gum arabic is contained in said gum arabic solution in an amount of 0.1–10 wt. %.

14. A method according to claim 12, wherein said diluted mixture contains as an additional component a thickener other than gum arabic such that an aqueous solution which contains only said thickener at the same concentration as a concentration of said thickener in said cleaning solution gives surface tension of not lower than 50 dyn/cm at ordinary temperature.

15. A method according to claim 14, wherein said thickener is selected from the group consisting of: polyvinyl pyrrolidone, copolymer of methoxyethylene and maleic anhydride, xanthan gum, and hydroxyethyl cellulose.

16. A method according to claim 12, wherein said diluted mixture further contains at least one of a preservative, a buffer and a tonicity agent.

17. A method according to claim 16, wherein said preservative is contained in an amount of 0.0001–0.5 wt. %.

18. A contact lens cleaning solution comprising a protease in an amount effective for removing protein adhering or clinging to said contact lens, and gum arabic as a hydrophilicity rendering component, wherein divalent metal ions in said gum arabic are inactivated by chelation using a chelating agent in an amount of not smaller than 7 wt. % of the amount of said gum arabic.

19. A contact lens cleaning solution according to claim 18, wherein said chelating agent is selected from the group consisting of ethylene diamine tetraacetic acid, citric acid, nitrilotriacetic acid, uramil diacetic acid, phosphoric acid and water-soluble salts thereof.

20. A contact lens cleaning solution according to claim 18, further comprising as an additional component a thickener other than gum arabic such that an aqueous solution that contains only said thickener at the same concentration as a concentration of said thickener in said cleaning solution gives surface tension of not lower than 50 dyn/cm at ordinary temperature.

21. A method of cleaning a contact lens using a gum arabic solution containing gum arabic as a hydrophilicity rendering component and in which divalent metal ions present in said gum arabic have been inactivated by chelation using a chelating agent in an amount of not smaller than 7 wt. % of the amount of said gum arabic, said contact lens being immersed in a diluted mixture that is obtained by diluting a protease solution with said gum arabic solution, so as to remove protein adhering or clinging to said contact lens and to render surfaces of said contact lens hydrophilic.

22. A method according to claim 21, wherein said diluted mixture contains as an additional component a thickener other than gum arabic such that an aqueous solution that contains only said thickener at the same concentration as a concentration of said thickener in said cleaning solution gives surface tension of not lower than 50 dyn/cm at ordinary temperature.

23. A method of treating gum arabic containing divalent metal ions to render said gum arabic suitable for use in contact lens cleaning solutions and the like, said method comprising subjecting said gum arabic to any of dialysis, gel filtration or a precipitation reaction with a precipitant to remove said divalent metal ions from said gum arabic, and recovering the gum arabic having said divalent metal ions removed therefrom.

24. A contact lens cleaning solution according to claim 18, wherein said divalent metal ions in said gum arabic are inactivated by chelation using said chelating agent in an amount of not smaller than 10 wt. % of the amount of said gum arabic.

25. A method according to claim 21, wherein said divalent metal ions in said gum arabic solution have been inactivated by chelation using said chelating agent in an amount of not smaller than 10 wt. % of the amount of said gum arabic.

* * * * *